United States Patent [19]

Kaye

[11] 4,046,153

[45] Sept. 6, 1977

[54] CIGARETTE HOLDER

[75] Inventor: Paul Kaye, Farmington Hills, Mich.

[73] Assignee: Aquafilter Corporation, Farmington Hills, Mich.

[21] Appl. No.: 662,565

[22] Filed: Mar. 1, 1976

[51] Int. Cl.[2] ..... A24F 13/62

[52] U.S. Cl. ..... 131/187

[58] Field of Search ..... 131/187, 190, 188, 175, 131/178, 182

[56] References Cited

U.S. PATENT DOCUMENTS

| | | | |
|---|---|---|---|
| 150,000 | 4/1874 | Dale | 131/187 |
| 1,186,727 | 6/1916 | Anderson | 131/188 |
| 3,137,303 | 6/1964 | Shaw | 131/187 |
| 3,646,944 | 3/1972 | Banoczi | 131/187 |

*Primary Examiner*—Stephen C. Pellegrino
*Attorney, Agent, or Firm*—Wolf, Greenfield & Sacks

[57] ABSTRACT

A cigarette holder construction having a casing with a mouthpiece end, a cigarette receiving end and a metal sleeve inserted in the cigarette receiving end. Inwardly extending projections are arranged radially about the inner surface of the sleeve to engage and removably secure the inserted end of a cigarette against accidental dislodgment. The mouthpiece end of the cigarette casing is provided with a removable plug having a body section frictionally engaging with the mouthpiece opening of the casing and an enlarged head integral with the body.

13 Claims, 5 Drawing Figures

CIGARETTE HOLDER

BACKGROUND OF THE INVENTION

The present invention relates to disposable cigarette filters of the type generally illustrated in U.S. Pat. Nos. 3,375,920 and 3,137,303. Disposable cigarette filters of this type are made with an absorbent fibrous filter impregnated with a fluid such as water. Such filters must be designed for automatic, efficient and inexpensive manufacture. These filters must also be designed for ease and safety in use. To attain these and other ends, filters of this type have been made with insert metal sleeves designed to be inserted in the cigarette receiving end of a plastic casing. These metal sleeves are intended to be used as heat sinks as well as means for engaging the cigarette which is inserted in the sleeve. The sleeves which have been used heretofore do provide adequate heat sinks. However, these sleeves do not always satisfactorily secure an inserted cigarette.

Cigarettes frequently accidentally fall from the sleeve when the filter is in use. These inadvertencies are both annoying to the user and hazardous; it is therefore desirable to eliminate them as far as possible. The sleeves which have been in use heretofore do not adequately secure the cigarette from accidental dislodgment at all times because of the diameter variation that occurs from cigarette to cigarette.

Cigarette filters of this type which contain a charge of water or the like must be prepackaged in such a manner as to seal the ends of the filter against evaporation. Several systems have been in use for this purpose. For example, as shown in U.S. Pat. No. 3,375,920 the mouthpiece end is normally sealed by dipping it in a liquid plastic which then solidifies into a tearable film. Other means have been used which include a twist off key or plug which is integrally formed with the cigarette casing and which is adapted to be twisted off to expose the mouthpiece opening. Both of these systems have limitations. In the case of the twist off means, the twist off element is frequently damaged and knocked off during the processing and fabrication of the filter. Since these filters are made on automatic machinery, a complete filter with a defective closure at the mouthpiece end is often completely fabricated before the defect is noted. Such defective filters are commercially useless in the absence of some simple means for effecting a closure.

SUMMARY OF THE INVENTION

It is an object of the present invention to overcome the defects and limitations of the prior art as described above. In the present invention there is provided an improved sleeve construction made of metal and designed to be inserted in the cigarette receiving end of the casing. This annular sleeve is provided with a plurality of radially arranged projections extending inwardly from the inner annular surface of the sleeve. These projections are designed to releasably engage an inserted cigarette. These inwardly extending projections are formed from gouged or upset portions in the inner surface of the sleeve and define barb-like elements which secure an inserted cigarette against accidental dislodgment from the sleeve.

The present invention also provides an improved means of closing the mouthpiece end of a cigarette filter which is normally charged with a fluid medium. The means for sealing the mouthpiece end of the cigarette filter comprises a plug having a body section designed to frictionally engage the mouthpiece opening of a cigarette casing. This body section is integrally formed with an axially aligned head having a diameter normally larger than the diameter of the body section and providing a means by which the plug may be inserted and removed from the filter.

These and other objects and advantages of the present invention will be more clearly understood when considered in conjunction with the accompanying drawings.

DESCRIPTION OF THE DRAWINGS

In the accompanying drawings.

DETAILED DESCRIPTION OF DRAWINGS

Figure 2:
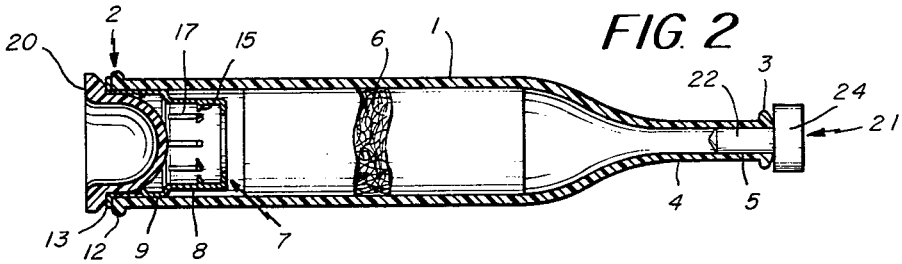
FIG. 2 is an enlarged cross sectional view taken essentially along line 2—2 of FIG. 1, with the exception that certain portions are not shown in cross section.

The casing 1 is formed of a suitable injection molded plastic. This casing has a cylindrical cross section for the major portion of its length from its cigarette receiving end 2 towards its mouthpiece end 3. A segment 4 of the casing 1 adjacent to the mouthpiece end 3 is flattened in a conventional fashion for ease in gripping the filter between the user's lips. The casing is preferably hollow as illustrated in FIG. 2 and is formed with a cylindrical opening 5 at its mouthpiece end. The central interior portion of the filter is provided with a fibrous filter material 6 which is suitably impregnated with water or a similar fluid in a manner as previously described in the patents referred to above. The fiber mass 6 is ordinarily formed of a cylindrical segment secured against movement towards the mouthpiece end by the narrowed section 4 and against movement outwardly through the cigarette receiving end 2 by frictional engagement with the inner walls of the casing 1 and by the sleeve 7.

The sleeve 7, which fits snugly within the cylindrical casing 1 at the cigarette receiving end 2, is formed with annular segments 8 and 9. The annular segment 8, inward of the receiving end 2, has a diameter which is less than the diameter of the second segment 9. The second annular segment 9 frictionally engages the inner wall 10 of the casing 1 adjacent to the cigarette receiving end 2. The cigarette receiving end 2 of the casing 1 is preferably formed with a bead 12 that projects outwardly at the cigarette receiving end. The second annular segment 9 is provided with an annular lip 13 that overlies and engages the bead 12 to properly position the sleeve in the casing.

On the inner wall of segment 8 is formed means in the form of inwardly extending projections 15 that are designed to engage and removably secure the inserted end of a cigarette. Preferably a plurality of these inwardly extending projections 15 are arranged radially about segment 8 in coplanar alignment with one another. The projections 15 preferably provide a barb-like element that is designed to engage the wall of an inserted cigarette. These barb-like projections 15 are preferably formed by gouging or deforming the inner surface of the segment 8 so as to remove a section of metal along a path as illustrated at 17 to form the barbs or projections 15.

A similar set of inwardly projecting barb-like members 18 are radially arranged about the second segment 9, also coplanar with one another. Preferably approximately eight such barbs are formed in each of the segments 8 and 9 in a radial configuration designed to uniformly engage the walls of a cigarette. As illustrated the sleeve is formed with different diameter segments as to normally be useful with any of several differently dimensioned cigarettes.

Figure 1:
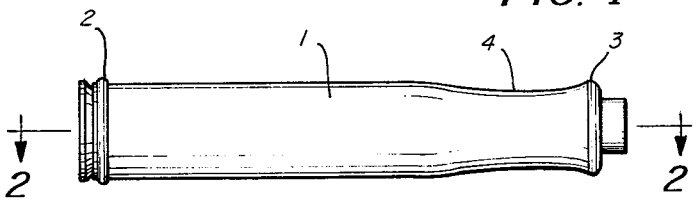
FIG. 1 illustrates a plan elevation of a cigarette filter embodying my invention.
Figure 3:
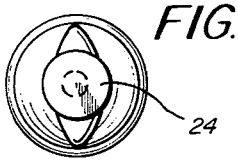
FIG. 3 is an end view of the assembly illustrated in FIG. 2 looking from the right or mouthpiece end thereof.
Figure 4:
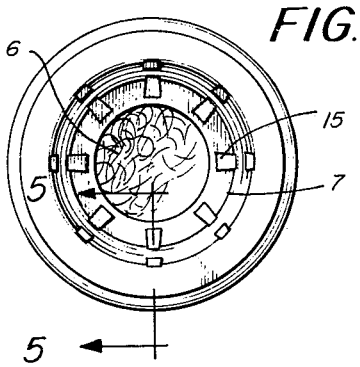
FIG. 4 is an enlarged end view looking from the left, or cigarette receiving end, of FIG. 2 with the insert plug or closure removed.
Figure 5:
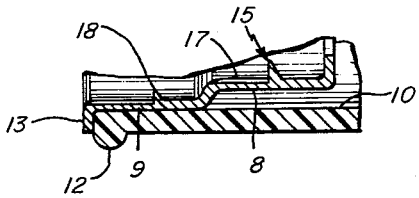
FIG. 5 is a cross sectional detail taken essentially along line 5—5 of FIG. 4.

The ends of this filter are preferably sealed to prevent evaporation of the fluid impregnating the filter 6 until the cigarette filter is ready for use. A conventional removable plug such as illustrated at 20 may be used in the cigarette receiving end. A plug 21 is used to close the mouthpiece end. The plug 21 is designed with a body section 22 adapted to frictionally fit and engage the cylindrical opening in the mouthpiece end 3. The body section 22 of the plug 21 extends, when in place, axially into the mouthpiece a sufficient distance to permit a firm frictional engagement which will not disengage under normaly packaging and handling activities. Integral with the body section 22 is a head 24. The head 24 is preferably cylindrical in configuration with a diameter that is greater than the narrowest diameter of the mouthpiece end 3, (See FIG. 2) but is less than the longest diameter of the mouthpiece end (See FIG. 1). This arrangement, as is best illustrated in FIG. 3, provides suitable means for engaging and removing the plug from the mouthpiece end 2 in preparation for the use of the filter.

The plug 21 is designed primarily for use in the salvaging of partially damaged cigarette filters, which damage is occasioned during the fabrication process. As previously indicated, the mouthpiece end is frequently made with an integrally formed closure. This closure is often knocked off or from the casing during processing. The plug illustrated and described provides an efficient means for salvaging this merchandise. The filters which have been formed completely except for the damaged closure at the mouthpiece end can be readily collected by workers and closed manually with the plug 21, thus making them merchantable. The plug shape and design is such as to facilitate the manufacture of these cigarette filters using assembly line techniques for such salvage.

What is claimed is:

1. A cigarette holder construction having a casing with a mouthpiece and a cigarette receiving end, a sleeve insert cigarette receiving end, said sleeve comprising an annular wall having an inner surface and an outer surface, said outer surface having at least a portion thereof frictionally engaging the cigarette receiving end of the casing, and said inner surface having a plurality of rigid inwardly extending projections spacedly circumferentially disposed for engaging the tip of a cigarette inserted in said sleeve with the projections subscribing a circular locus having a diameter less than an outer diameter of the cigarette.

2. A cigarette holder as set forth in claim 1 wherein said inwardly extending projections are formed by upsetting portions of said inner surface.

3. A cigarette holder as set forth in claim 1 wherein said sleeve comprises a plurality of annular segments in longitudinal alignment with one segment closer to said mouthpiece end and having a diameter smaller than the diameter of a second segment more remote from said mouthpiece end, said second segment frictionally engaging the cigarette receiving end of said casing, and said inwardly extending projections extending inwardly from the inner surface of at least one of said segments.

4. A cigarette holder as set forth in claim 3 wherein said projections are radially arranged on the inner surfaces of both of said segments.

5. A cigarette holder as set forth in claim 4 wherein said projections are formed by upsetting portions of said inner surface and with said projections having a barb-like configuration.

6. A cigarette holder as set forth in claim 1 wherein said projections are pointed projections disposed about the sleeve.

7. A cigarette holder as set forth in claim 6 wherein said projections are each defined by a channel-like deformation on the inner surface terminating in the projection.

8. A cigarette holder as set forth in claim 7 wherein said channel-like deformation is formed by removing a section of metal along a path to form a barb-like projection.

9. A cigarette holder as set forth in claim 8 wherein said barb-like projection is integrally formed with the sleeve.

10. A cigarette holder as set forth in claim 1 wherein said sleeve comprises a plurality of annular segments in longitudinal alignment and of different diameter, said inwardly extending projections extending inwardly from the inner surface of at least two of said segments.

11. A cigarette holder as set forth in claim 10 wherein said segments comprise two segments each of about the same length with the projections extending from the midpoint circumference of each segment.

12. A cigarette holder construction having a casing with a mouthpiece end and a cigarette receiving end, a sleeve in said cigarette receiving end, said sleeve comprising an annular wall having an inner surface and an outer surface, said outer surface having at least a portion thereof frictionally engaging the cigarette receiving end of the casing, and said inner surface having a plurality of rigid inwardly extending projections for engaging the tip of a cigarette inserted in said sleeve with the projections subscribing a circular locus having a diameter less than an outer diameter of the cigarette.

13. A cigarette holder construction as set forth in claim 12 wherein the projections are formed by upsetting portions of said inner surface, the upset portions including channel-like deformations on the inner surface each terminating in the projection.

* * * * *